US005769283A

United States Patent [19]

Owada et al.

[11] Patent Number: 5,769,283

[45] Date of Patent: Jun. 23, 1998

[54] FIXED-AMOUNT SPRAY TYPE AEROSOL CONTAINER

[75] Inventors: Ryoichi Owada, Uji; Satoshi Mekata, Ibaraki, both of Japan

[73] Assignee: Osaka Shipbuilding Co., Ltd., Osaka, Japan

[21] Appl. No.: 615,198

[22] PCT Filed: Aug. 29, 1994

[86] PCT No.: PCT/JP94/01424

§ 371 Date: Apr. 11, 1996

§ 102(e) Date: Apr. 11, 1996

[87] PCT Pub. No.: WO96/06650

PCT Pub. Date: Mar. 7, 1996

[51] Int. Cl.[6] ..... B65D 83/14

[52] U.S. Cl. ..... 222/402.2

[58] Field of Search ..... 222/402.2

[56] References Cited

U.S. PATENT DOCUMENTS

| | | | |
|---|---|---|---|
| 3,104,785 | 9/1963 | Beard, Jr. | 222/402.2 X |
| 3,185,356 | 5/1965 | Venus, Jr. | 222/402.2 |
| 3,405,846 | 10/1968 | Klun | 222/402.2 |
| 5,037,013 | 8/1991 | Howlett | 222/402.2 |

*Primary Examiner*—Kevin P. Shaver

*Attorney, Agent, or Firm*—Armstrong, Westerman, Hattori, McLeland & Naughton

[57] ABSTRACT

A fixed-amount spray type aerosol container in which stem rubber is pressed against a mounting cap by a spring provided below the stem connected to a nozzle, and a tank is fixed between a guide bush that fixes the stem rubber and a housing, the container including a valve with a shape stabilizer installed between the guide bush and the tank. The container is nearly free from entry of external air and can spray the contents at a nearly constant amount until the contents nearly run out.

2 Claims, 6 Drawing Sheets

FIXED-AMOUNT SPRAY TYPE AEROSOL CONTAINER

FIELD OF THE INVENTION

The present invention relates to a fixed-amount spray type aerosol container. More specifically, the present invention relates to a fixed-amount spray type aerosol container which is filled with compressed air and which can inject the contents therein at a nearly fixed amount almost every time, even if fixed amount spray type aerosol container is used repeatedly.

BACKGROUND OF THE INVENTION

Hitherto, in order to allow the active ingredients that give tastes, drug effects and similar to directly act on a desired portion such as nasal cavity, palate, oral cavity, pharynx and tongue, such process is designed so that the active ingredients are liquefied and filled in a so-called nebulizer type finger-pressing air pump, and the liquefied active ingredient is sprayed over a desired portion in the oral cavity.

However, the nebulizer type finger-pressing air pump has problems that, because a nozzle moves vertically in operating the air pump, it is extremely difficult to precisely spray the active ingredient onto a specific portion only, and in addition, when the nozzle is restored to the original position, the external air is sucked into the air pump, creating a fear that the inside of the air pump is contaminated by various germs present in air.

Therefore, for a method to allow active ingredients to directly act on a specific portion, investigation has been made on a method for filling active ingredients in an aerosol container and spraying the active ingredients over the specific portion. However, since the active ingredients are continuously sprayed when an aerosol container is used, the active ingredients attach to the specific portion in large quantities, whereby generating side effects or wasting the active ingredients.

Therefore, under these circumstances, the present inventors made earnest efforts to develop products which can precisely give active ingredients to a desired portion, and at the same time is free from entry of air outside the product into the inside thereof and ensures high sanitation, and further is able to spray the active ingredients of a fixed amount using compressed gas, and finally have found such products and have completed the present invention.

SUMMARY OF THE INVENTION

That is, the present invention relates to a fixed-amount spray type aerosol container in which a stem rubber is pressed against a mounting cap by a spring provided below a stem connected to a nozzle, and a tank is fixed between a guide bushing that fixes the stem rubber and a housing, the container including a shape stabilizer installed between the guide bushing and the tank.

The fixed-amount spray type aerosol container of the present invention, includes the combination of: a container body having an opening therethrough leading to a chamber therein; a housing having a main body portion and a flange, wherein the flange is supported on the opening of the container body and the main body portion hangs suspendedly through the opening in the chamber of the container body; a gasket between an outer surface of the housing and an inner surface of the container body; mounted over the opening in the container body so as to be in contact with the flange of the housing; a stem having first and second ends, wherein the first end projects out of the container body through an opening in the mounting cap and the second end projects into the container body within the housing; a stem rubber fitted around the stem; a spring fitted around the second end of the stem and pressing the stem rubber to the mounting cap; a nozzle attached to the first end of the stem; a dip tube connected to the housing within the chamber of the container body; a guide bushing located between the stem and the housing; a tank, having a bottom portion and a side wall, is located between the guide bushing and the housing, wherein the tank is supported by the housing so that the bottom portion of the tank makes sealing contact with the housing and the side wall of the tank is pressed radially inwardly by a pressure of a gas charged in the container body; facilities for stabilizing a shape of the tank, wherein the shape stabilizer facilities are located at spaced intervals between the guide bushing and the tank; and a fixed-amount chamber formed between the guide bushing and the tank.

DETAILED DESCRIPTION OF THE INVENTION

The fixed-amount spray type aerosol container according to the present invention will be described in detail referring to the attached drawings.

Figure 1:
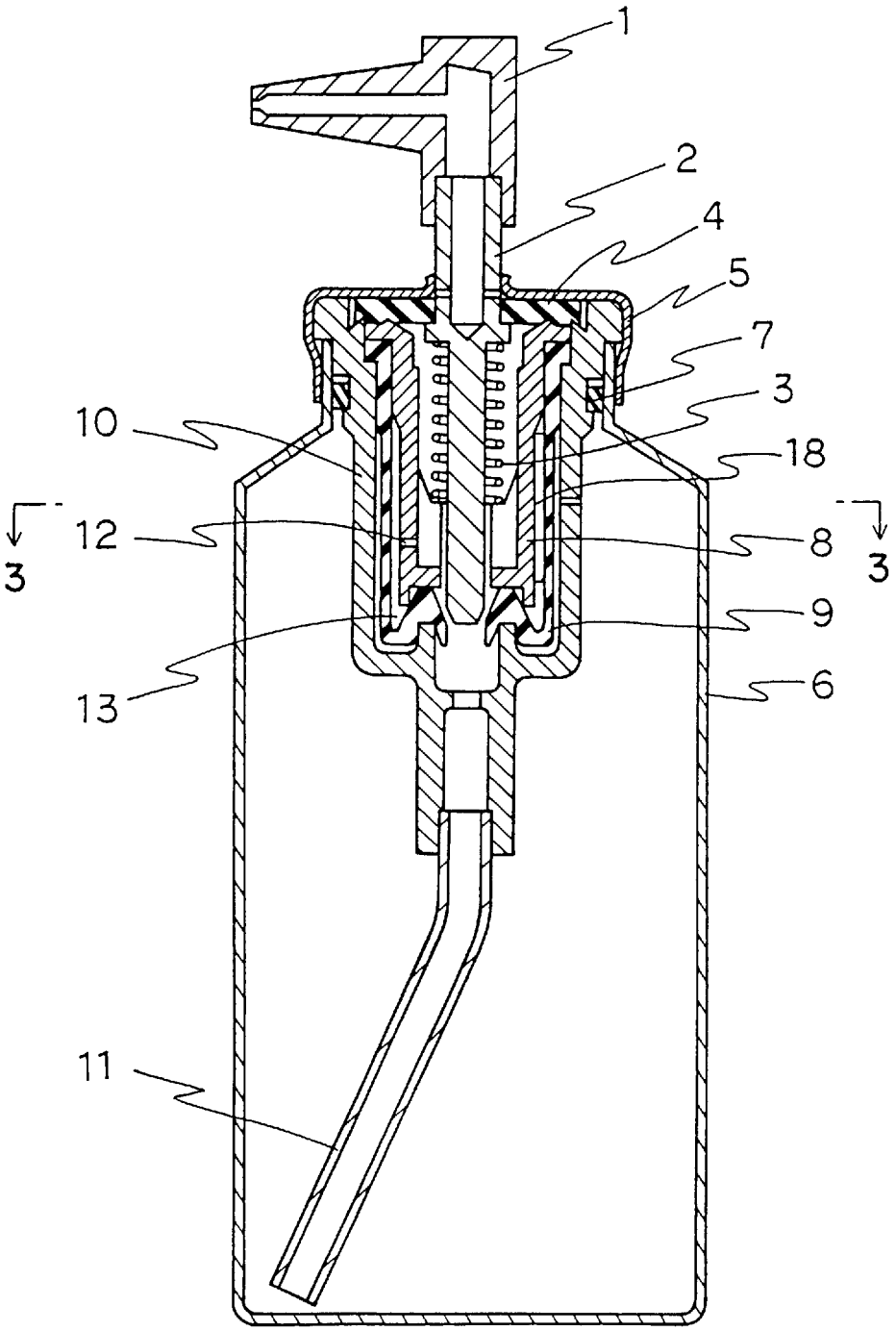
FIG. 1 is a schematic sectional view of a fixed-amount spray type aerosol container according to the present invention when not in use.

FIG. 1 is a schematic sectional view showing an embodiment of a fixed-amount spray type aerosol container according to the present invention at a steady state (at a or when not in use).

A nozzle 1 is connected to a stem 2, and a stem rubber 4 is pressed against a mounting cap 5 by a spring 3 provided below the stem 2. A container body 6 is sealed and fixed between the mounting cap 5 and a gasket 7, whereby the aerosol container is kept under a hermetically sealed condition.

To the outer periphery of a guide bushing 8 which fixes the stem rubber 4, is provided a tank 9 is provided comprising material with flexibility, for example, natural rubber, synthetic rubber such as nitrile rubber (NBR), butyl rubber (IIR) and silicone rubber, elastomer, soft plastics or similar, and the tank 9 is fixed by a housing 10. To the bottom surface of the housing 10, a dip tube 11 is connected. For the tank 9, it is desirable to use silicone rubber because active ingredients are not absorbed or decomposed.

The contents filled in the aerosol container enter the housing 10 via the dip tube 11, and enter the inside of the guide bushing 8 via a clearance between the stem 2 and the tank 9 as well as a clearance between the stem 2 and the guide bushing 8. The contents then fill a fixed-amount chamber 13 formed between the guide bushing 8 and the tank 9 via a hole 12.

Figure 2:
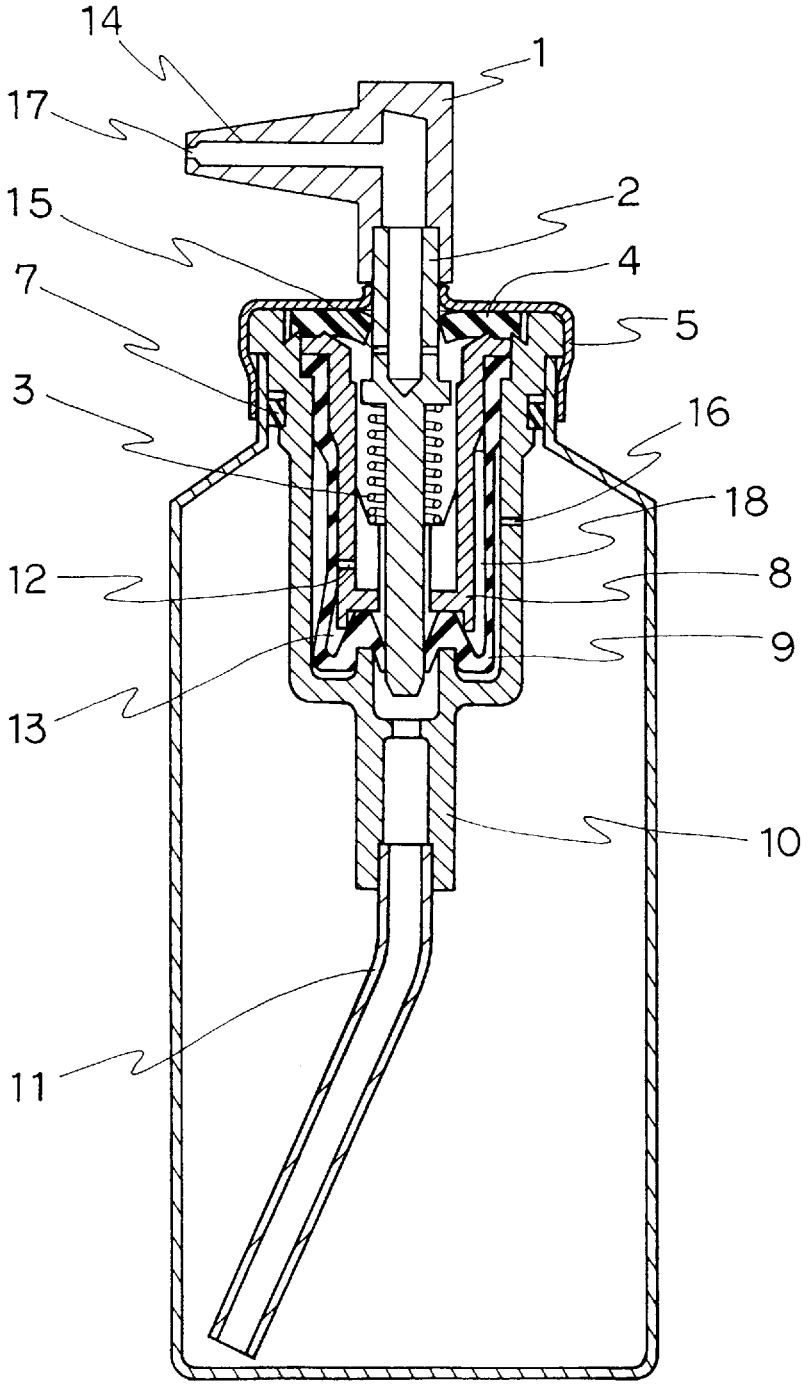
FIG. 2 is a schematic sectional view of a fixed-amount spray type aerosol container according to the present invention in operation.

Pressing the nozzle 1 downwards can activate the aerosol container as shown in FIG. 2.

The contents in the aerosol container enter the housing 10 via the dip tube 11, but since a clearance between the bottom of the stem 2 and the tank 9 is completely sealed, the contents are not introduced into the guide bushing 8.

Because internal pressure of the aerosol container is greater than external pressure (atmosphere) thereof, when the nozzle 1 is pressed downwards and a guide hole 14 of the nozzle 1 is brought in free communication with the fixed-amount chamber 13 via a guide hole 15 and guide bushing 8, the tank 9 deforms as shown in FIG. 2 by the pressure of the contents in the aerosol container introduced via the communicating hole 16, and the contents in the fixed-amount chamber 13 are sprayed from a spray hole 17 via the hole 12 and guide holes 15 and 14, successively.

In the present invention, a shape stabilizer 18 is provided between the guide bushing 8 and the tank 9. Thus, when the contents are sprayed from the spray hole 17, the tank 9 deforms nearly uniformly and the shape of the tank 9 is stabilized, and the tank 9 does not deform unevenly as in the case when the shape stabilizer 18 is not provided, whereby enabling repeated fixed-amount spray of the contents.

In FIG. 1 and FIG. 2, the shape stabilizer 18 is formed as a so-called rib on the outer periphery of the guide bushing 8, and the shape of the shape stabilizer 18 is not particularly limited, but examples include a quadrate prism, semicircular cylinder, and similar. In order to deform the tank 9 into an orderly shape, it is desirable not to provide a clearance between the shape stabilizer 18 and the tank 9 as shown in FIG. 1 and FIG. 2. If the number of the shape stabilizer 18 located between the guide bushing 8 and the tank 9 is excessively small, the tank 9 is difficult to uniformly deform, while if it is excessively large, the deformation amount of the tank becomes small to lessen the spray amount of the contents. It is, therefore, desirable to locate shape stabilizers, in general, at 3–16 places, though it depends on the shape of the shape stabilizer 18.

Figure 3:
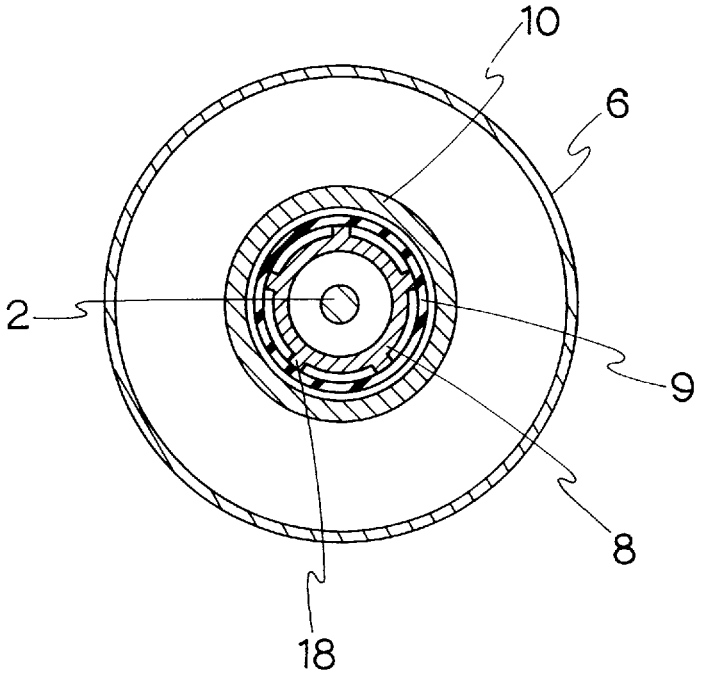
FIG. 3 is a sectional view taken along the line A—A of the fixed-amount spray type aerosol container according to the present invention in FIG. 1.

FIG. 3 shows a fractured surface at section A—A of FIG. 1.

Figure 4:
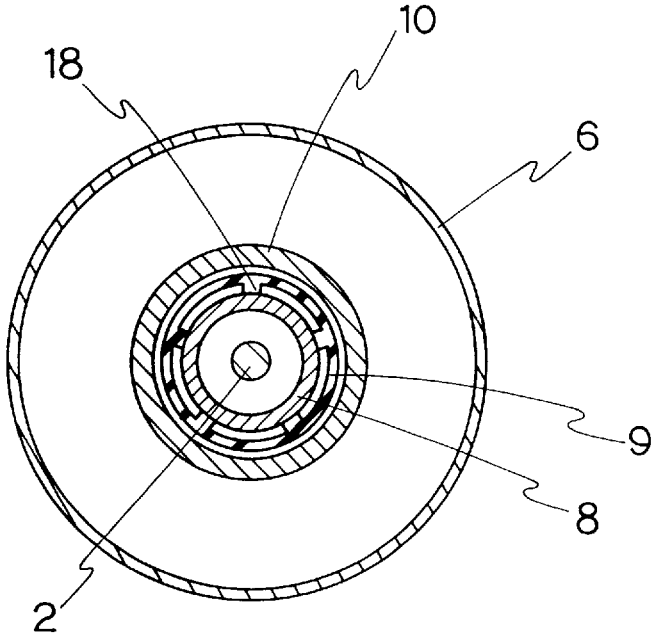
FIG. 4 is a sectional view taken along the line A—A of FIG. 1 showing an example of another shape stabilizer used for the fixed-amount spray type aerosol container according to the present invention.

In FIG. 3, the shape stabilizer 18 is formed at five places as so-called ribs on the outer periphery of the guide bushing 8 as described before. In this way, in the present invention, the shape stabilizer 18 might be provided on the outer periphery, and as shown in FIG. 4, it might not be provided on the outer periphery of the guide bushing 8, but might be provided on the inner periphery of the tank 9.

In addition, another member might be inserted and formed between the guide bushing 8 and the tank 9 in the form of a so-called spacer.

As stated above, when the fixed-amount spray type aerosol container according to the present invention shown in FIG. 1 and FIG. 2 is used, the tank 9 always deforms in a nearly constant shape, enabling the contents to be filled in the fixed-amount chamber 13 to be sprayed to the outside via the spray hole 17 of the nozzle 1 in a fixed amount.

Because the fixed-amount spray type aerosol container according to the present invention can spray the contents to the outside in a fixed amount not only when liquefied gas such as LPG is used for a spray agent, but also even when compressed gas such as air, $N_2$, $CO_2$ or $N_2O$ is used, it provides an advantage of being used for a wide range of various applications.

The fixed-amount spray type aerosol container according to the present invention will be described in further detail by way of examples, but the present invention shall not be limited to such examples.

EXAMPLE 1

4 grams of purified water and 12 grams of glycerin were placed in a container body (full filling volume: 28 ml), and using sterilized compressed air as a spray agent, the container body was filled with them so that the internal pressure achieved 6.0 kg/cm$^2$ at 25° C. Using the valve (shape stabilizers were arranged at 5 places) shown in FIG. 1 and FIG. 2, the valve and a nozzle were attached to the container body to make an aerosol product.

The contents (purified water and glycerin) were sprayed through the nozzle from the aerosol product obtained, and the change of spray amount and internal pressure were measured. The results are shown in FIG. 5.

Figure 5:
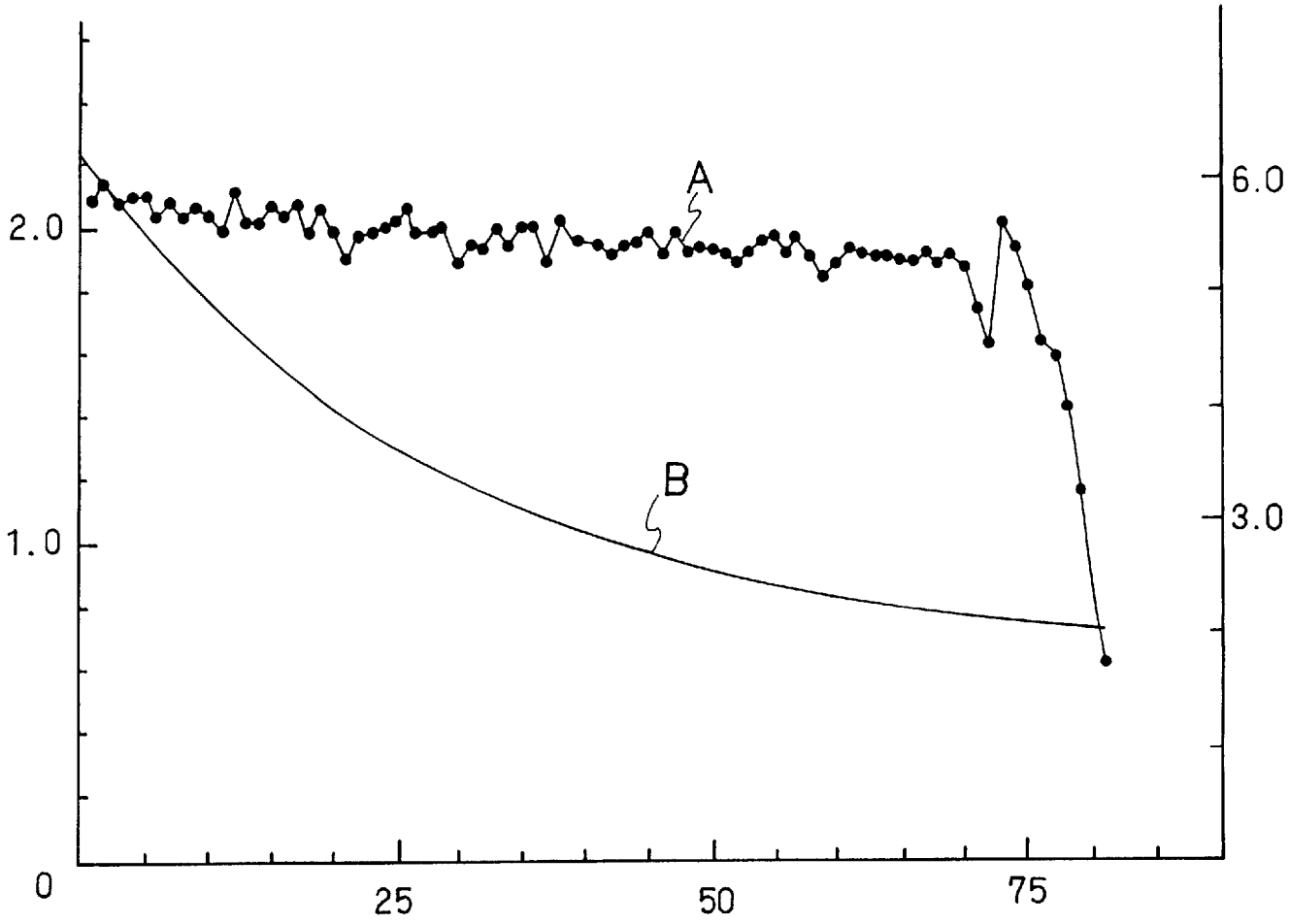
FIG. 5 is a graph showing the relationship between spray frequency and spray amount and internal pressure when the fixed-amount spray type aerosol obtained in Example 1 according to the present invention is used.

The results shown in FIG. 5 indicate that when the fixed-amount spray type aerosol container was used, as shown in Graph A, the contents could be sprayed at a nearly constant amount until the contents scarcely remained in the container, and as shown in Graph B, even if there was a fluctuation in internal pressure, the change of the spray amount was small.

COMPARATIVE EXAMPLE 1

In Example 1, an aerosol product was made in the same manner as in the case of Example 1 except that shape stabilizers were removed.

From the aerosol product obtained, the contents were sprayed through the nozzle, and the change of spray amount and internal pressure were measured. The results are shown in FIG. 6.

Figure 6:
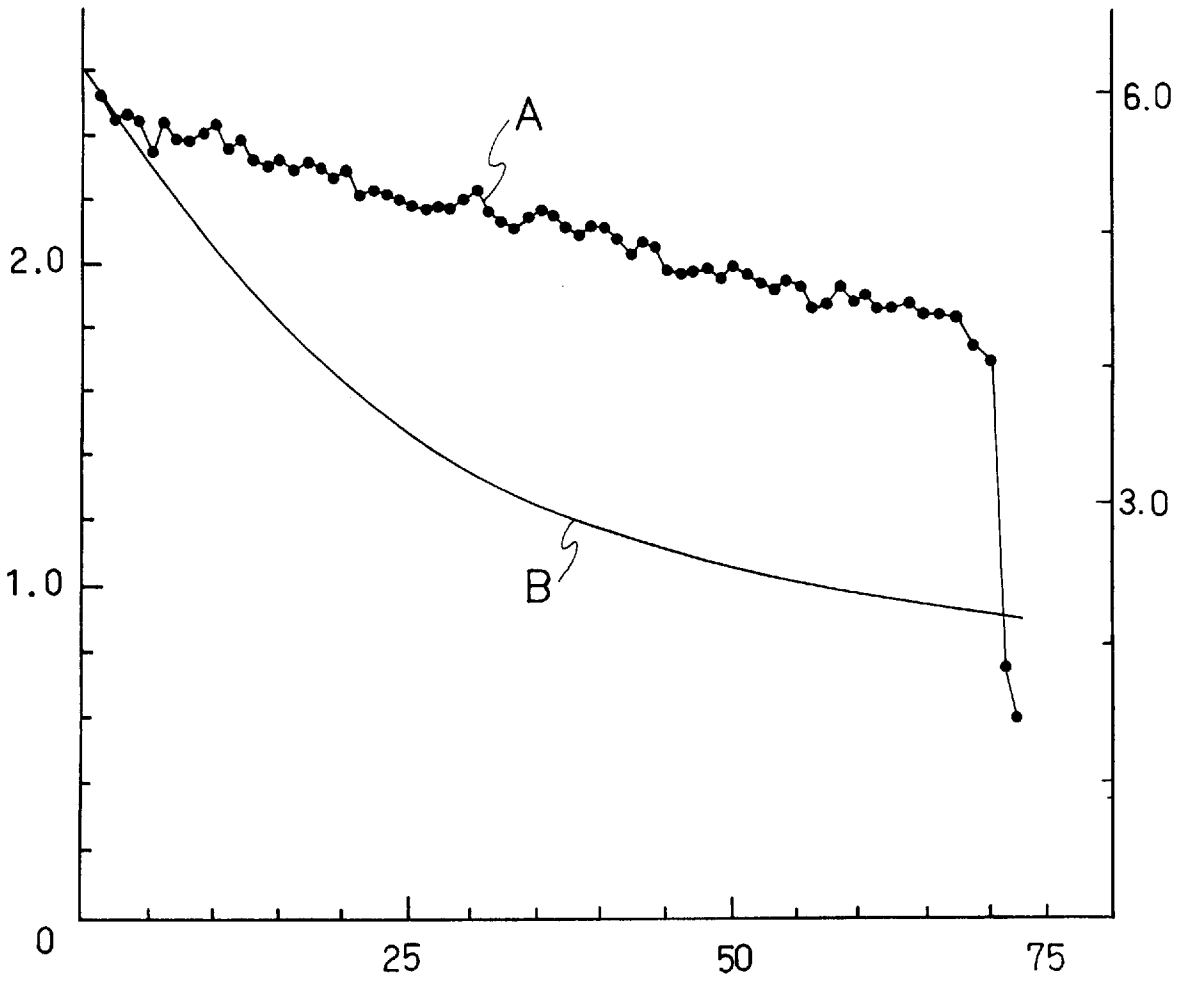
FIG. 6 is a graph showing the relationship between spray frequency and spray amount and internal pressure when an aerosol container obtained in Comparative Example 1 according to the present invention is used.

The results shown in FIG. 6 indicate that the aerosol container obtained in Comparison 1 greatly decreased the spray amount as the spray frequency increased as shown in Graph A as the internal pressure varied as shown in Graph B.

Comparison between Example 1 and Comparative Example 1 indicates that the fixed-amount spray type aerosol container of Example 1 with shape stabilizers provided between the guide bushing and the tank can spray the contents at a fixed amount until the contents nearly run out.

The fixed-rate spray type aerosol container according to the present invention provides an effect that it is nearly free from entry of external air and it can spray the contents at a nearly constant amount until the contents nearly run out.

INDUSTRIAL APPLICABILITY

The fixed-amount spray type aerosol container according to the present invention can spray the contents nearly at a fixed amount, even if it is filled with compressed gas and is repeatedly used, so that it is particularly useful for an aerosol container for spraying liquid active ingredients into the oral cavity.

We claim:

1. A fixed-amount spray type aerosol container comprising:

a container body having an opening therethrough leading to a chamber therein;

a housing having a main body portion and a flange, wherein said flange is supported on said opening of said container body and said main body portion hangs suspendedly through said opening in said chamber of said container body;

a gasket between an outer surface of said housing and an inner surface of said container body;

a mounting cap mounted over said opening in said container body so as to be in contact with said flange of said housing;

a stem having first and second ends, wherein said first end projects out of said container body through an opening in said mounting cap and said second end projects into said container body within said housing;

a stem rubber fitted around said stem;

a spring fitted around said second end of said stem and pressing said stem rubber to said mounting cap;

a nozzle attached to said first end of said stem;

a dip tube connected to said housing within said chamber of said container body;

a guide bushing located between said stem and said housing;

a tank, having a bottom portion and a side wall, is located between said guide bushing and said housing, wherein said tank is supported by said housing so that said bottom portion of said tank makes sealing contact with said housing and said side wall of said tank is pressed radially inwardly by a pressure of a gas charged in said container body;

means for stabilizing a shape of said tank, wherein said shape stabilizer means are located at spaced intervals between said guide bushing and said tank; and a fixed-amount chamber formed between said guide bushing and said tank.

2. The fixed-amount spray type aerosol container of claim 1, wherein said shape stabilizer means are a plurality of radially extending ribs which are integral with any one of an outer periphery of said guide bushing and an inner periphery of said tank.

* * * * *